US006129292A

United States Patent [19]

Leung et al.

[11] Patent Number: 6,129,292

[45] **Date of Patent: *Oct. 10, 2000**

[54] NOVELTY DRINKING STRAW

[75] Inventors: Wallace W. K. Leung, Tuen Mun; Michael W. K. Keung, Wan Chai, both of The Hong Kong Special Administrative Region of the People's Republic of China

[73] Assignee: Simon Marketing, Inc., Los Angeles, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 09/411,168

[22] Filed: Oct. 1, 1999

Related U.S. Application Data

[63] Continuation-in-part of application No. 09/307,130, May 7, 1999, abandoned.

[51] Int. Cl.[7] ..... A47G 21/18

[52] U.S. Cl. ..... 239/33; 239/211; 446/176

[58] Field of Search ..... 239/33, 41, 16, 239/24; D7/300.2; 446/176, 397

[56] References Cited

U.S. PATENT DOCUMENTS

| | | |
|---|---|---|
| D. 225,486 | 12/1972 | Bart . |
| D. 260,655 | 9/1981 | Guay . |
| D. 275,542 | 9/1984 | Hacke . |
| D. 294,671 | 3/1988 | Koziol . |
| 2,126,858 | 8/1938 | Zadek . |
| 2,663,866 | 12/1953 | Simpson . |
| 2,722,153 | 11/1955 | Greco . |
| 2,787,055 | 4/1957 | Wertz . |
| 2,800,825 | 7/1957 | Toussaint . |
| 2,811,808 | 11/1957 | Briese . |
| 2,980,039 | 4/1961 | Jolly . |
| 3,122,959 | 3/1964 | Barr . |
| 3,315,405 | 4/1967 | Hoffer . |
| 3,332,622 | 7/1967 | Lombard . |
| 3,398,624 | 8/1968 | Stoessel et al. . |
| 3,510,643 | 5/1970 | File . |
| 3,592,195 | 7/1972 | Wagenen . |
| 3,627,161 | 12/1971 | Wergeland . |
| 3,655,325 | 4/1972 | Toppel . |
| 3,782,028 | 1/1974 | Kelly . |
| 3,834,068 | 9/1974 | Fabricant . |
| 3,839,793 | 10/1974 | Crapio . |
| 3,879,885 | 4/1975 | Fabricant . |
| 3,957,202 | 5/1976 | Hornsby, Jr. . |
| 4,072,314 | 2/1978 | Rosen et al. . |
| 4,121,835 | 10/1978 | Garabedian . |
| 4,207,673 | 6/1980 | DiGiorlamo et al. . |
| 4,211,024 | 7/1980 | Nickell ..... 239/33 |
| 4,252,273 | 2/1981 | Karterman . |
| 4,282,681 | 8/1981 | McCaslin . |

(List continued on next page.)

FOREIGN PATENT DOCUMENTS

| | | |
|---|---|---|
| 63-118868 | 1/1988 | Japan . |
| 2331024 | 5/1999 | United Kingdom . |
| WO 94/17691 | 8/1994 | WIPO . |
| WO 98/53892 | 12/1998 | WIPO . |
| WO 99/13685 | 3/1999 | WIPO . |

OTHER PUBLICATIONS

U.S. application No. 09/050,306, filed Mar. 30, 1998 and entitled Novelty Article.

Sample of Joyworld Singing Straw produced by Joy World, Inc., Franklin Lakes, NJ in packaging dated 1997.

*Primary Examiner*—Andres Kashnikow
*Assistant Examiner*—Christopher S. Kim
*Attorney, Agent, or Firm*—Brinks Hofer Gilson & Lione

[57] ABSTRACT

A novelty drinking straw designed to play an electronically recorded voice or other sound when a liquid passes through the straw is disclosed having improved safety and entertainment value. The novelty drinking straw has a detachable sound module and an improved sealing member to prevent damage to the electronic circuitry in the sound module.

26 Claims, 6 Drawing Sheets

U.S. PATENT DOCUMENTS 4,341,230 7/1982 Siahou .
4,347,683 9/1982 Maxim .
4,383,386 5/1983 Giordano et al. .
4,531,310 7/1985 Acson et al. .
4,579,281 4/1986 Karterman .
4,631,715 12/1986 Hoover ..... 446/397
4,646,350 2/1987 Batra .
4,726,518 2/1988 Martina et al. ..... 239/33
4,765,623 8/1988 Cardillo et al. .
4,779,344 10/1988 Panisch .
4,809,335 2/1989 Rumsey .
4,828,527 5/1989 Spector .
4,840,371 6/1989 Harris .
4,914,748 4/1990 Schlotter, IV et al. .
4,936,780 6/1990 Cogliano .
4,973,941 11/1990 Davis et al. .
5,073,140 12/1991 Lebensfeld et al. .
5,075,970 12/1991 Albert .
5,094,644 5/1992 Kelley .
5,099,232 3/1992 Howes .
5,130,696 7/1992 Liebman .
5,209,692 5/1993 Coleman et al. .
5,228,879 7/1993 Fromm .
5,393,258 2/1995 Karterman .
5,439,103 8/1995 Howes .
5,464,092 11/1995 Seeley .
5,536,196 7/1996 Sternberg .
5,575,383 11/1996 Seeley .
5,625,347 4/1997 MacLean et al. .
5,722,590 3/1998 Miller .
5,785,406 7/1998 Lee .
5,939,983 8/1999 Rudell et al. ..... 340/540
5,969,278 12/1972 Tsai ..... 84/94.2

12
10
16
14

12
10
20
14
16
18

NOVELTY DRINKING STRAW

CROSS-REFERENCE TO RELATED APPLICATIONS

This application is a continuation-in-part of U.S. Application Ser. No. 09/307,130, filed May 7, 1999, entitled "NOVELTY DRINKING STRAW" (abandoned).

FIELD OF THE INVENTION

This invention relates to a novelty drinking straw. More particularly, the present invention relates to a novelty drinking straw that provides entertaining sounds and has a detachable sound module.

BACKGROUND OF THE INVENTION

Drinking straws capable of providing entertaining sound or visual effects can provide a pleasant distraction for both adults and children. Prior art novelty straws have included straws designed to mechanically produce sounds. For example, U.S. Pat. No. 3,398,624 discloses a straw having an integrally formed reed in one end so that the straw may be used as a musical instrument. U.S. Pat. No. 4,121,835 discloses another sound producing straw that has a sound track in the form of embossed ridges on the outside of the straw. The ridges on the straw cooperate with tabs on a lid of a beverage container to produce sounds when the straw is moved up or down through the beverage lid. Although these straws can produce sounds, they do not automatically generate sounds in response to a liquid passing through the straw.

One prior art device that does automatically generate sounds when a liquid passes through the straw utilizes a battery-powered circuit. The circuit in this device includes two contacts that penetrate a thick, frangible plastic tube. Liquid passing through the tube and touching the two contacts completes the battery-powered circuit and causes the device to play a group of tones. The circuit is encased in a sealed housing attached to the outside of the tube. While this device does automatically generate sounds in response to drinking through the straw, it has several drawbacks. One drawback is that it is difficult to clean. The sealed housing is not removable and so the device continuously plays a tune while being washed. This can cause the battery to drain prematurely. Also, the device should not be cleaned in hot water because the glue or wax around the contacts may leak and allow water through the holes in the tube made by the two contacts. Accordingly, there is a need for an improved novelty drinking straw.

BRIEF SUMMARY OF THE INVENTION

The present invention discloses a novelty drinking straw that addresses the drawbacks in the prior art.

According to a first aspect of the invention, a novelty drinking straw includes a straw for receiving a liquid, where the straw is formed as a hollow tubular member having a length and a circumference. Each of two electrically conductive contacts has a first portion positioned inside the straw and a second portion positioned outside the straw. A sealing module is coaxially disposed about the circumference of the straw and is sized to receive the electrically conductive contacts and prevent liquid from escaping through the circumference of the hollow tubular member. A first outer housing assembly is removably connected to the sealing module. A second outer housing assembly has a sound generating module that is electrically connectable with the electrically conductive contacts. A first integrally formed connector on the first outer housing assembly is cooperative with a second integrally formed connector formed on the second outer housing assembly to form a manually detachable connection between the first and second outer housing assemblies so that the sound module is removable from the straw with the second outer housing assembly.

According to a second aspect of the present invention, a novelty drinking straw is provided having a straw and two electrically conductive contacts. Each of the contacts has a first end positioned inside the straw and a second end positioned outside the straw, wherein each of the contacts passes through a respective opening in the circumference the straw. A sealing module mounted on the straw is sized to receive the electrically conductive contacts and prevent the liquid from escaping. An outer housing removably attaches to the sealing module and the straw. The outer housing includes an outer shell structure, a support plate connected to the outer shell structure, where the support plate includes a connector portion manually attachable to the sealing module, and a sound generating module positioned inside a cavity formed by the outer shell and the support plate. The sound generating module is configured to play an electronically recorded voice or other sound in response to a liquid passing through the straw.

DETAILED DESCRIPTION OF THE PRESENTLY PREFERRED EMBODIMENTS

Figure 1:
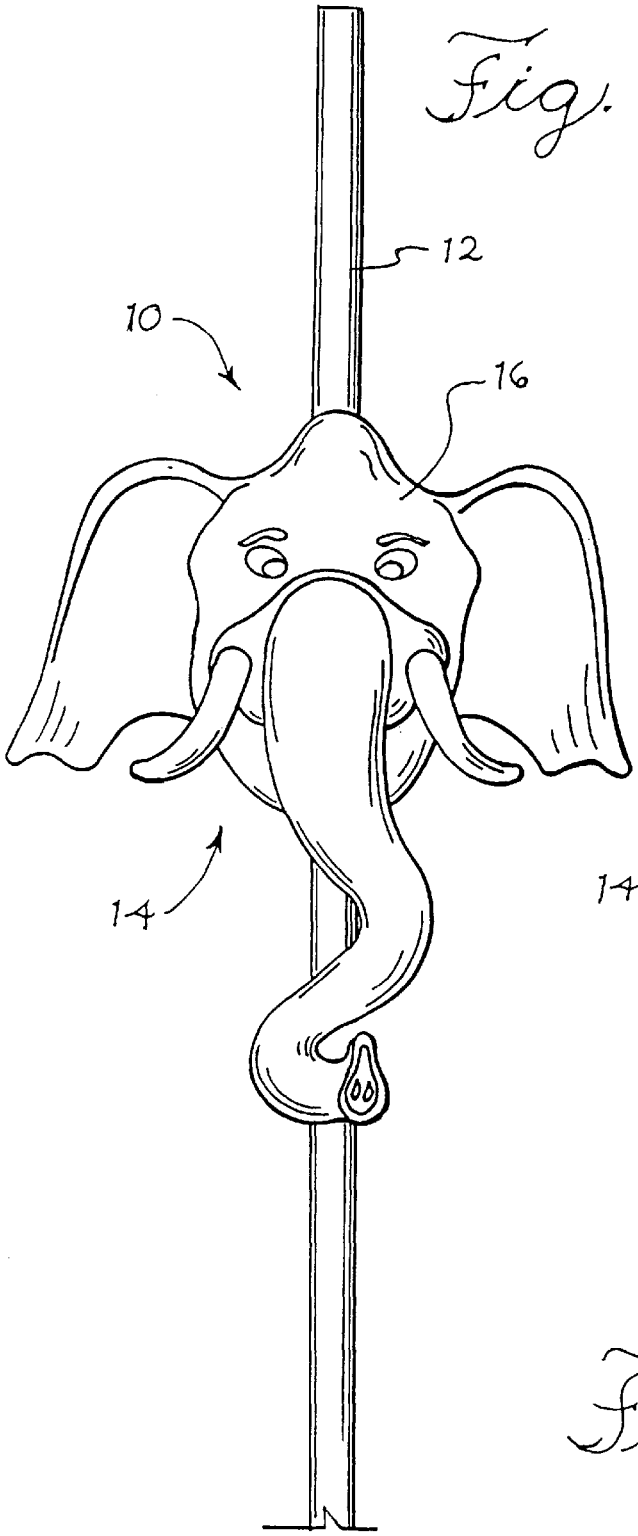
FIG. 1 is a front elevational view of a novelty drinking straw according to a preferred embodiment.
Figure 2:
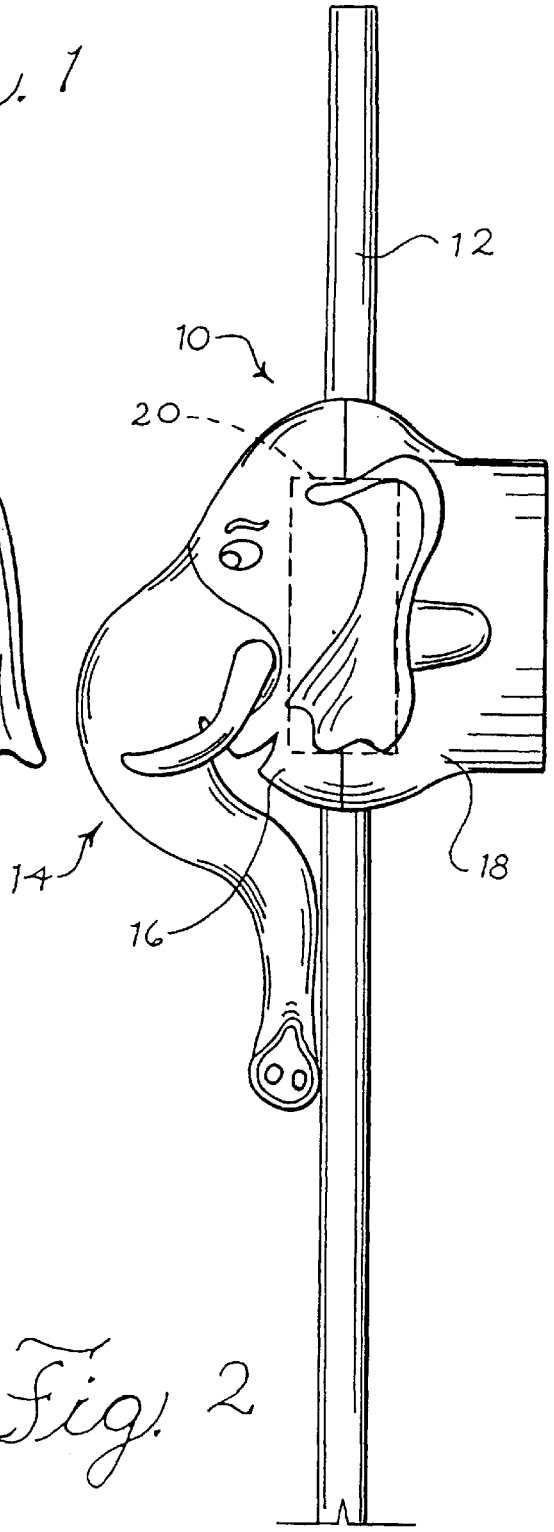
FIG. 2 is a side view of the novelty drinking straw of FIG. 1.
Figure 3:
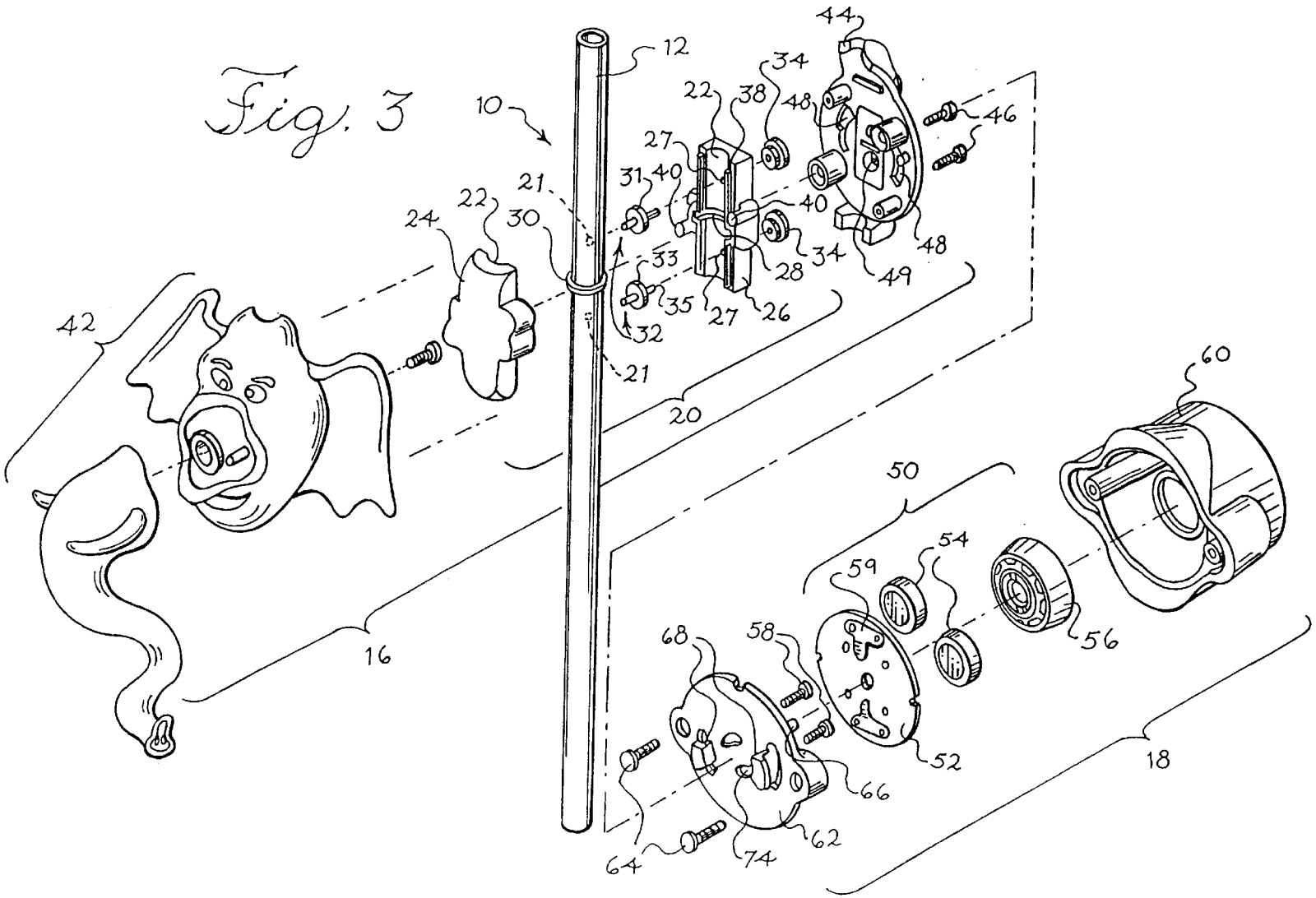
FIG. 3 is an exploded perspective view of the novelty drinking straw of FIGS. 1 and 2.

FIGS. 1–3 illustrate a novelty drinking straw 10 according to a preferred embodiment. The novelty drinking straw 10 includes a straw 12 constructed of a hollow tubular material and a housing assembly 14 attached to the straw 12. The housing assembly 14 includes a front housing assembly 16 and a rear housing assembly 18. As illustrated in FIG. 3, the rear housing assembly 18 is removably attachable to the front housing assembly 16. As explained in detail below, a pair of electrical contacts 32 inside the front housing assembly 16 penetrate the straw 12 and are positioned so that a first portion of each contact contacts liquid drawn through the straw 12 and a second portion of each contact extends outside of the straw. A complementary pair of rear electrical contacts 58 is positioned in the rear housing assembly 18. The rear electrical contacts 58 are in communication with two spring contacts 59 on the sound generating module 50 and are positioned to complete a circuit with the contacts 32 in the front housing assembly 16 when the novelty drinking straw 10 is fully assembled and liquid in the straw is touching the contacts 32.

As best shown in FIG. 3, a sealing module 20 is positioned around the straw to prevent leakage of liquid where the pair of electrical contacts 32 penetrates the straw 12. In one preferred embodiment, the sealing module 20 includes a tubular body positioned coaxially about the straw 12. The tubular body has first and second halves 24, 26 each having an interior surface 22 designed to conform to the exterior surface of the straw 12. The interior surfaces 22 of the first and second halves also include a groove 28 sized to fit over a seal, preferably an O-ring 30, placed around the straw 12. The second half 26 includes a pair of openings 27, each defining a passage from the interior surface 22 to the exterior of the second half 26. The pair of openings 27 are preferably sized to each receive an electrical contact 32 and a seal 34 positioned around the electrical contact 32. Each of the contacts 32 has a first portion 31 that extends into the straw 12 through a respective opening 21 in the wall of the straw. A circumferential flange 33 on each contact 32 has a diameter greater than the diameter of the openings 21 in the straw 12, or the openings 27 in the sealing module 20, that prevents radial movement of the contact 32.

Each of the halves 24, 26 of the tubular body in the sealing module 20 includes a longitudinal sealing area 38 along the edge opposing the opposite half. The sealing area 38 is designed to keep the two halves 24, 26 properly aligned and further prevent liquid from escaping the sealing module 20. The opposing halves 26, 24 of the tubular body also preferably include an alignment post 40 and an alignment post receiving area (not shown) to properly align the halves. A glue applied to the interior surface 22 of the sealing module 20 prevents the straw from moving with respect to the sealing module. When assembled, the seals 34 in the sealing module 20 prevent liquid from escaping from the straw and into the rear housing assembly and the O-ring prevents liquid from causing a short-circuit between the pair of electrical contacts 32. An advantage of the O-ring and seals over, for example, a simple glue or wax seal, is that hot liquids drawn through the straw during cleaning or use are less likely to degrade the seal and cause leakage.

The straw 12 may be constructed of any commonly used plastic straw material. In one embodiment, a PVC material having a thickness of at least 1.0 mm may be used for this straw. Other materials, selected to have a thickness corresponding to a desired strength and stiffness, may also be used. The straw 12 may be of any desired length, straight or curved, and may be of any desired diameter. In one preferred embodiment, the straw is approximately 0.256 inches in diameter. In another embodiment, the straw is at least 0.375 inches in diameter so as to decrease the likelihood of a small child placing an end of the straw in his ear canal and causing injury. Also, the plastic material is preferably a flexible, non-frangible plastic. The contacts 32, 58 are preferably constructed of a nickel-plated, stainless steel material. The O-ring 30 and seals 34 may be constructed of an elastomeric material such as synthetic rubber. One suitable synthetic rubber is Kraton™.

The front housing assembly 16 surrounds the sealing module 20 with a front outer shell 42 on one side and a rear support plate 44 attached to the rear of the front outer shell 42 on the opposite side. One or more fasteners 46, such as screws, hold the front housing assembly 16 together. The front outer shell may include an entertaining design that is formed in relief, or printed, on the surface of the front outer shell 42. In other embodiments, the front outer shell may include lights or mechanically movable parts to enhance the overall visual entertainment value of the novelty drinking straw 10. The rear support plate 44 also includes one or more connectors 48 designed to cooperate with respective connectors 68 on the rear housing assembly 18 to releasably connect the front and rear housing assemblies 16, 18.

As shown in FIG. 3, the rear housing assembly 18 includes a sound module 50 for generating sounds in response to the flow of a liquid through the straw 12. The sound module 50 includes a circuit board 52, a power source 54, and a loudspeaker 56. The circuit board 52 preferably includes a circuit 53 (FIG. 11) designed to generate a singing voice in response to detecting a liquid in the straw. The circuit board 52 includes a pair of spring contacts 59. The spring contacts 59 are configured to bias the sound module contacts 58 in the rear housing assembly 18 against the contacts 32 in the front housing assembly in order to achieve a good electrical connection when the housing assembly 14 is fully assembled. As described in more detail below, the circuit 53 may be configured to play a voice, a tune or selectively play one of several voices and/or tunes in different embodiments. The circuit 53 may also be configured to play other electronically recorded sounds.

Figure 11:
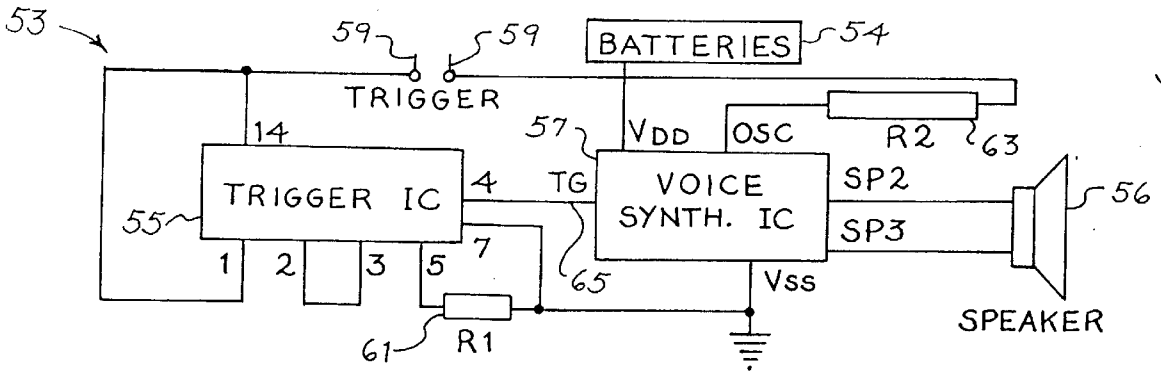
FIG. 11 is an illustration of a circuit for use in the sound module of FIG. 3.

Referring to FIG. 11, the circuit 53 includes two integrated circuits (ICs): a trigger IC 55 and a voice synthesizing IC 57. One of the spring contacts 59 on the circuitboard 52 is electrically connected to the trigger IC 55. The other of the spring contacts 59 is electrically connected to the power source 54. A first resistor 61, electrically connected between ground and the trigger IC 61, biases the trigger IC. A second resistor 63 is electrically connected to the batteries 54 and to an input of the voice synthesizing IC 57. The speaker 56 is electrically connected to the outputs of the voice synthesizing IC 57. A trigger signal line 65, electrically connecting the trigger IC 55 to the voice synthesizing IC 57, carries a trigger signal from the trigger IC to the voice synthesizing IC when the circuit 53 is activated. The voice synthesizing IC is preprogrammed to sing several seconds of a song or, in another embodiment, a group of songs.

A suitable voice synthesizing IC is the AMA032A available from ALPHA in Taiwan. One suitable trigger IC is the HD14069UBP manufactured by Wah Jing in China. The speaker may be any of a number of commercially available speakers such as part number ALM21-H7.2 available from Al Good Well Industries, Ltd. The power source 54 may be at least one, and preferably a pair, of batteries. In a preferred embodiment, the power source 54 may be a pair of batteries having a combined voltage of 2.5–3.0 volts to provide for normal operation of the novelty drinking straw 10. Suitable batteries are zinc-manganese dioxide alkaline button cells each having a nominal voltage of 1.5 Volts and available from Chener Battery Works Ltd. in Hong Kong. Referring to FIG. 11, the first resistor R1 preferably has a value of 120 kΩ and the second resistor may have a value ranging from 130 kΩ to 200 kΩ depending on the duration of sound emission that is desired.

In alternative embodiments, the circuit 53 on the circuit board 52 may be preprogrammed to play a tune or collection of tunes. In order to play a tune or other electronically recorded sound, the voice synthesizing IC 57 may be replaced by any of a number of commercially available tone generating ICs. In other embodiments, a switch-activated voice capture IC or discrete circuit may be used to allow a user to record sounds. The recorded sounds may then be played back when the sound module 50 is activated by a liquid touching the contacts 32.

Referring again to FIG. 3, the rear housing assembly 18 includes a rear outer shell 60 and a front support panel 62 that enclose the sound module 50. The rear outer shell 60 and front support panel are releasably connectable with fasteners 64, such as screws. As with the front outer shell 42, the rear outer shell 60 may be decorated, decoratively shaped, or unadorned. The interior face of the front support panel 62 includes one or more guides 66 extending out from the front support panel that are designed to position and stabilize the circuit board 52 within the cavity formed by the rear outer shell and front support panel 60, 62. The exterior face of the front support panel 62 preferably has an integrally formed connector 68.

Figure 7:
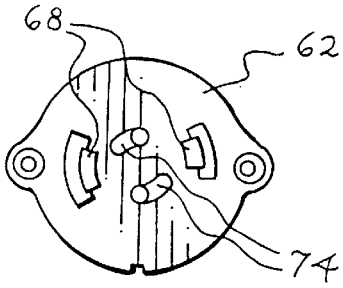
FIG. 7 is a plan view of the front support plate of the rear housing assembly shown in FIG. 3.
Figure 6:
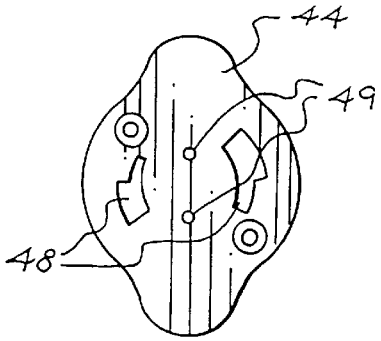
FIG. 6 is a plan view of the rear support plate of the front housing assembly shown in FIG. 3.

As shown in FIGS. 3 and 7, the integrally formed connector 68 on the front support panel 62 may be one or more tabs extending out from the exterior face of the front support panel 62. The corresponding connector 48 on the rear support panel 44 is best shown in FIGS. 3 and 6. The rear support plate 44 includes a pair of contact passages 49 sized to permit the ends of the contact pins 32 protrude from the front housing assembly 16. The front support plate 62 includes corresponding contact passages 74 to receive the ends of the contacts 32. The connectors 48, 68 on the front and rear support plates 16, 18 cooperate to form a manually engageable and releasable connection.

Figure 4:
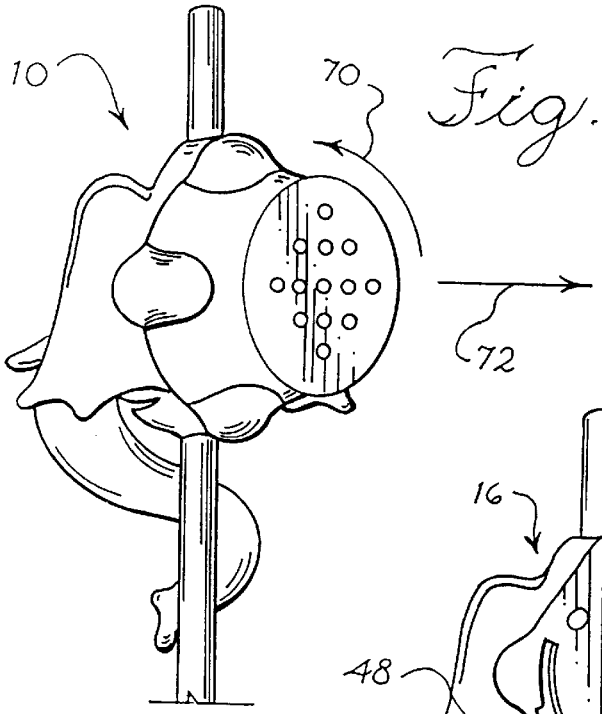
FIG. 4 is a rear perspective view of the novelty drinking straw of FIGS. 1 and 2 in an assembled state.
Figure 5:
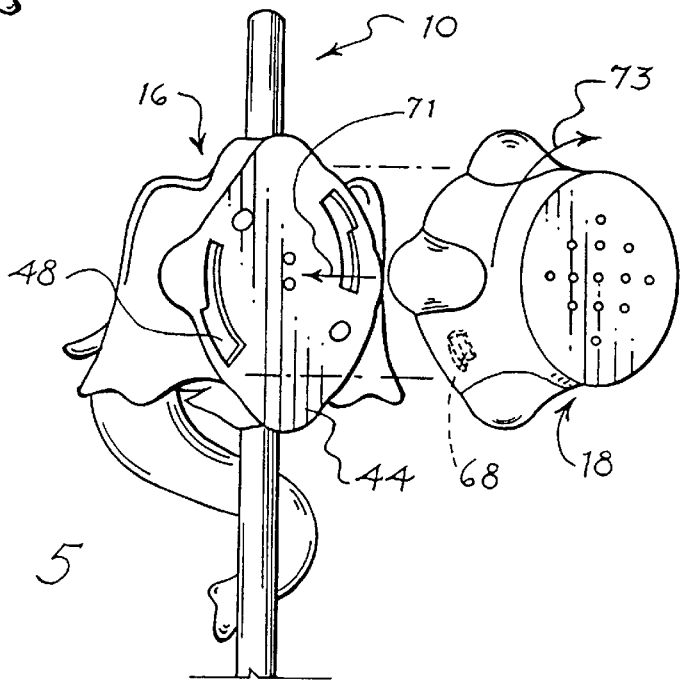
FIG. 5 is a rear perspective view of the novelty drinking straw of FIG. 4 in a disassembled state.

Referring now to FIGS. 4 and 5, to remove the rear housing assembly from the remainder of the novelty drinking straw 10, a user twists the rear housing assembly in a counterclockwise direction (at step 70) and pulls the rear housing assembly 18 away from the front housing assembly 16 (at step 72). This two step process is reversed to reconnect the front and rear housing assemblies 16, 18 (at steps 71, 73). In a preferred embodiment, the connectors 48, 68 are polarized such that the front and rear housings may only be assembled in one orientation (See FIGS. 6 and 7). Other embodiments of the manually releasable connection are contemplated such as tabs on the rear support panel and corresponding grooves on the front support panel or a combination of tabs and grooves on each of the front and rear support panels. In order to provide for an electrical connection between the electrical contacts 32 projecting out of the front housing assembly and the contact pads 58 in the rear housing assembly, a pair of arcuate grooves 74 extending through the front support panel 62 are designed to receive the ends of the protruding electrical contacts 32 and permit rotation of the rear housing assembly.

Figure 8:
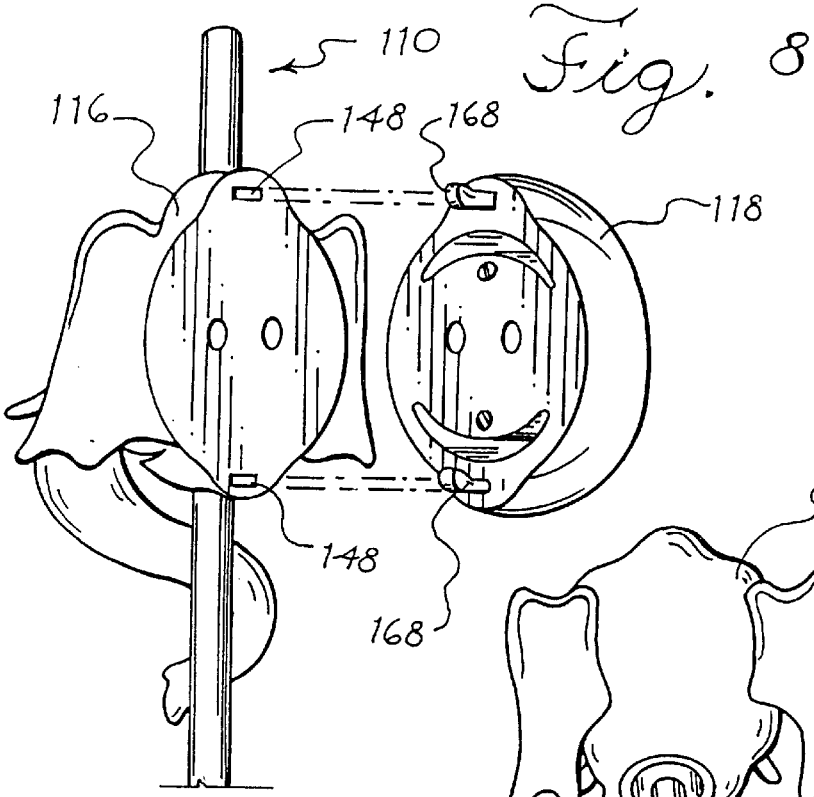
FIG. 8 is an exploded side view of a novelty drinking straw in a disassembled state according to a second preferred embodiment.

FIG. 8 illustrates another embodiment of the novelty drinking straw 110. A manually releasable connection between the front and rear housing assemblies 116, 118 includes a pair of snap-fit connections, each having a tab portion 168 on the rear housing and a corresponding tab receptacle 148 on the front housing assembly 116. As with the previous embodiment, the rear housing assembly containing the sound module, including the batteries, is removably connectable to the front housing assembly without the need for tools. Other manually releasable and engageable connectors, such as complementary male and female threaded areas, are also contemplated. Additionally, other connectors that do not require tools to engage or release are contemplated.

Figure 9:
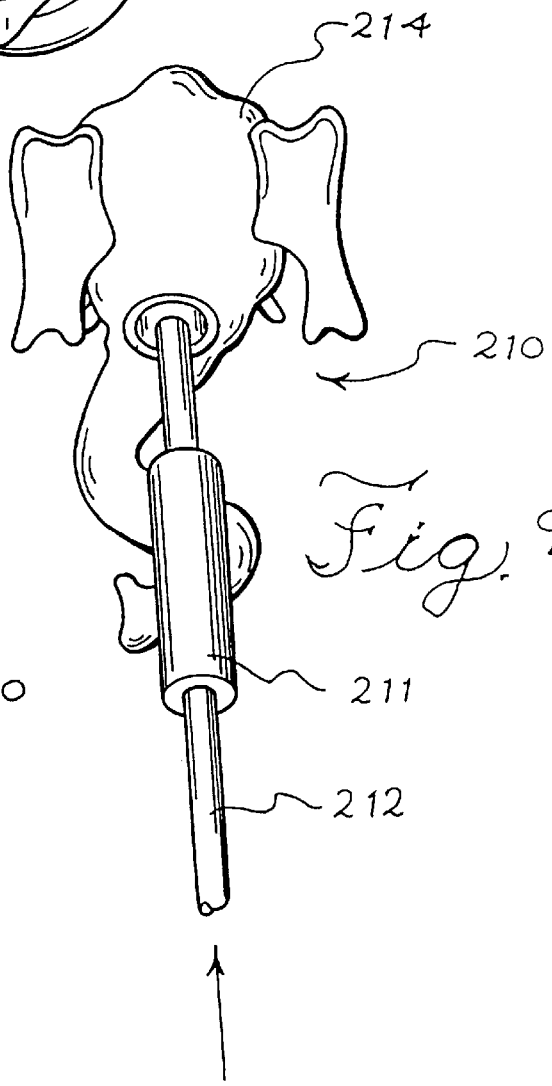
FIG. 9 is an exploded perspective view of a novelty drinking straw according to a third preferred embodiment.

FIG. 9 illustrates an alternative embodiment of a novelty drinking straw 210 having a removable sound module. The novelty drinking straw 210 includes a sealing module 211, for holding the electrical contacts and having one or more flexible seals (not shown), mounted coaxially around a straw 212. A single housing assembly 214 containing the sound module and batteries is slidably and coaxially mountable to the sealing module 211. The sealing module and housing assembly preferably incorporate connectors that are manually engageable and disengageable with one another so that no tools are necessary. An advantage of this embodiment is that the housing assembly, which may be formed in a decorative shape such as that of an animal or cartoon character, can remain intact when removing the housing assembly from the straw 212. The sound module (not shown) is positioned in the housing assembly 214 and may be removable from the sealing module 211. In other embodiments, the housing 214 and sound module may be integrally formed so that only the batteries used to power the sound module may be removed. In yet another embodiment, the entire housing assembly may be manually removable from the sealing module and permanently sealed to prevent tampering with the batteries or circuitry of the sound module.

One advantage of a sound module which may be manually removed from proximity with the straw is that the batteries and the electronic circuitry contained in the sound module are kept away from heat and/or moisture when the novelty drinking straw 10, 210 requires cleaning. This avoids possible damage to the batteries and electronic circuitry from exposure to moisture and high temperatures. The removable sound module also avoids the problem of excess battery drainage that will occur by unwanted operation of the electronic circuit during washing. Thus, the portion of the novelty drinking straw that comes in contact with a drinkable liquid and a user may be thoroughly cleaned while operative life of the electronics is preserved. The manually removable connection between the front and rear housing, or between the sealing tube 211 and housing 214, also reduces the time and effort necessary for assembly and disassembly during cleaning.

Referring to FIGS. 1–3, the novelty drinking straw, according to one preferred embodiment, operates to play an entire voice or other sound recording when activated. A liquid drawn through the straw 12 completes a circuit by touching both of the electrical contacts 32 penetrating the straw. The electrical contacts 32 are in electrical communication with the rear contacts and contact pads 59 in the rear housing assembly. Referring to the circuit embodiment of FIG. 11, when a conducting liquid passing through the straw touches both contacts 32, the circuit 53 is activated. The liquid flowing between the contacts completes a circuit path between the power source connected to one of the contacts and the trigger IC electrically connected to the other contact. Liquids such as juices or other beverages may be used. The trigger IC 55, recognizing that the circuit is complete, outputs a signal, such as an logic voltage "high", on the trigger signal line. When the voice synthesizing IC receives the signal, the recorded voice plays on the speaker 56. In one embodiment, the voice synthesizing IC 57 contains up to a three second voice recording. The circuitry 53 on the circuit board 52 may be configured to play an entire song every time a liquid is detected or to only play a song while a liquid maintains contact with the electrical contacts. Other lengths of recordings may also be used, as well as one or more voices or sounds in combination or sequence. In a preferred embodiment, once the voice circuit is activated, the entire length of the prerecorded voice material is played on the speaker.

Figure 10:
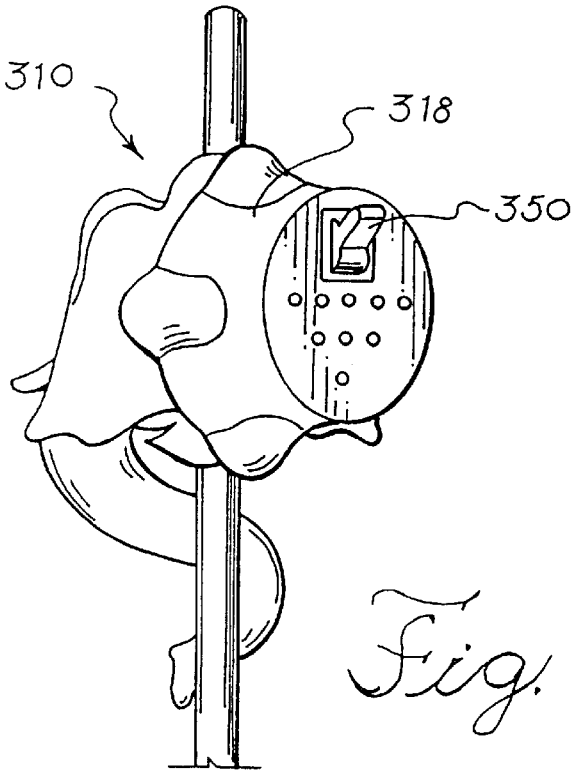
FIG. 10 is a rear perspective view of a novelty drinking straw according to a fourth preferred embodiment.

In another embodiment of the novelty drinking straw 310, as shown in FIG. 10, a button or switch 350 is positioned on the rear housing assembly 318. The switch 350 may be configured to manually activate or deactivate the sound module. A user may activate the sound module to play the song using the switch and without needing to draw liquid through the straw 312 in one embodiment. Alternatively, the switch 350 may be used to deactivate the sound module so that the novelty drinking straw 310 may be used without playing a song.

Figure 12:
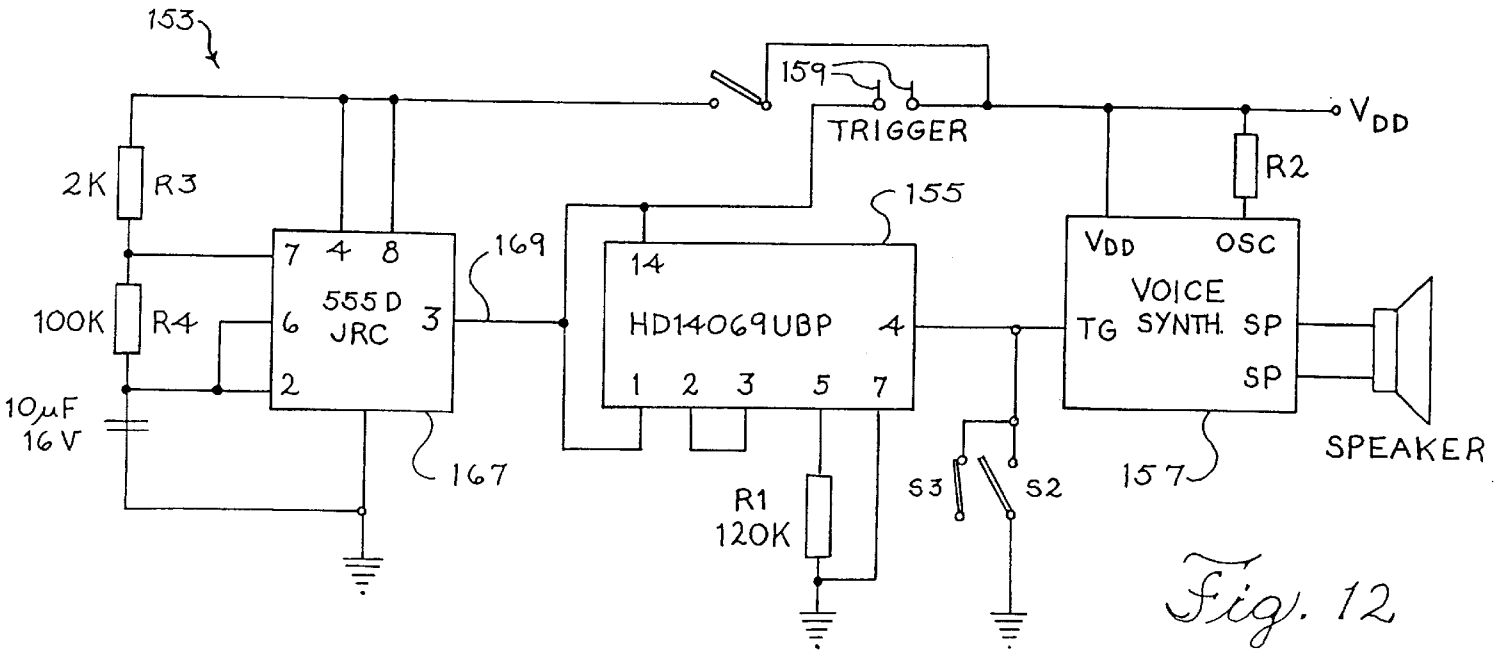
FIG. 12 is an illustration of a circuit for use in the novelty straw of the present invention according to a first alternative embodiment.

Referring to FIG. 12, a circuit 153 is shown with a three-way switch (shown as separate switch elements S1, S2, and S3 for ease of illustration) that will switch the sound module between three operating modes. When a first switch element is closed, the sound module will continuously play the recorded voice or other recorded sound. The first switch element S1, when closed, bypasses the contacts 159 so that the power source is electrically connected to a timer 167. The timer may be a JRC555D manufactured by New Japan Radio Co. Ltd. in Japan. The timer 167 outputs a continuous signal over an output line 169 that continuously activates the trigger IC 155 which, in turn, continuously activates the voice synthesizing IC 157. In a second position of the three-way switch, where switch element S2 is closed and the other switch elements S1, S3 are open, the sound module is turned off because the trigger signal line 165 is shorted to ground and cannot activate the voice synthesizing IC 157. In the third position of the three-way switch, when S3 is closed and the other switch elements S1, S2 are open, the sound module is activated by a liquid completing a circuit between the two contacts. In the embodiment of FIG. 12 the switch may be any of a number of known multi-position switches, such as sliding or rotary switches. The three-way switch may be mounted on an exterior portion of the housing assembly, or on a portion of one of the opposing front and rear support panels 62, 44 and electrically connected to the circuit board so that the switch is hidden when the front and rear housing assemblies are connected.

Figure 13:
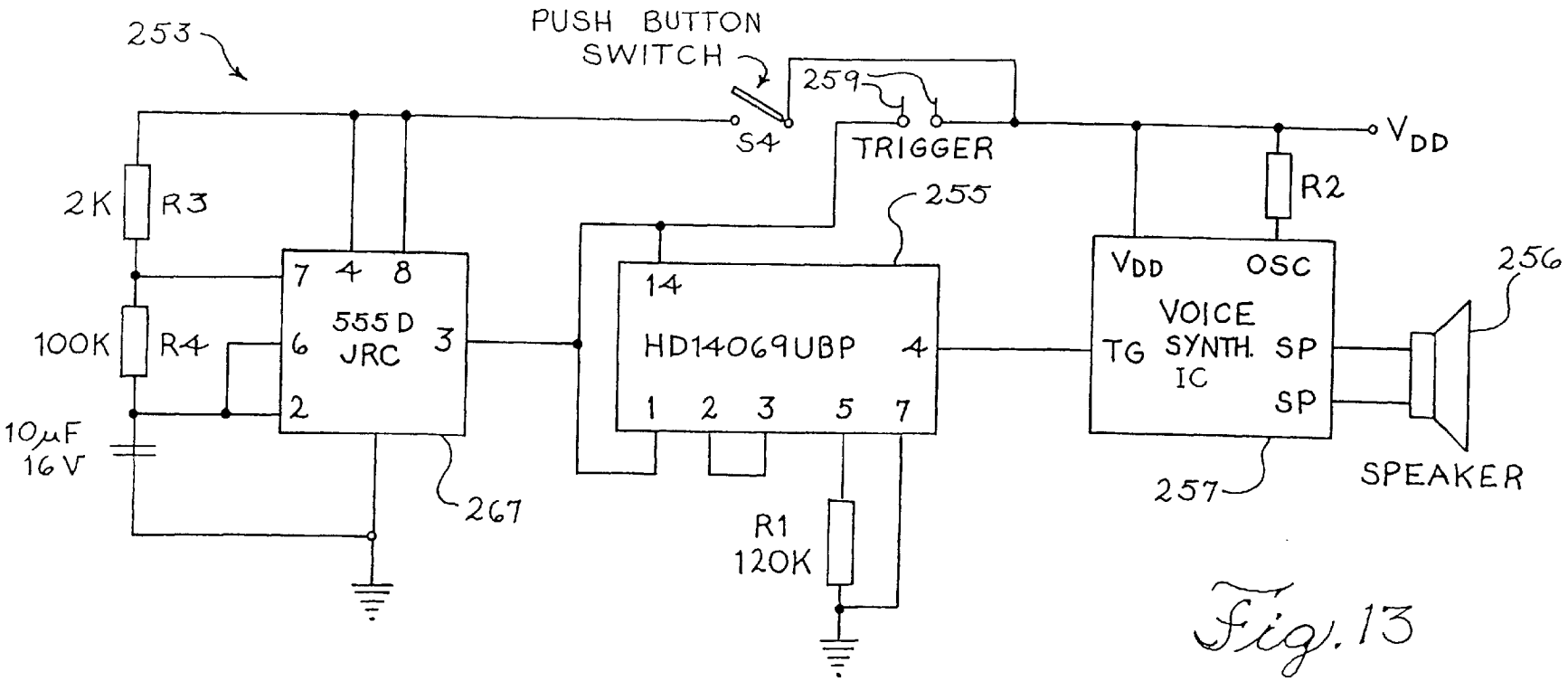
FIG. 13 is an illustration of a circuit for use in the novelty straw of the present invention according to a second alternative embodiment.

Another embodiment of the circuit is shown in FIG. 13. In this embodiment, the circuit 253 implements a two-position switch S4 that switches the novelty drinking straw between a continuous activation mode and liquid activation mode. When the switch S4 is open, the circuit 253 is in the liquid activation mode and functions as described above with respect to FIG. 11. Specifically, liquid passing through the straw completes a circuit across the contacts 259 that causes the trigger IC 255 to activate the voice synthesizing IC 257 (or other sound generating IC that is desired).

When the switch S4 is closed, the novelty drinking straw is in the continuous activation mode and the electronically recorded voice (or sound) continuously plays regardless of the presence of a liquid in the straw. Referring to FIG. 13, closing the switch S4 activates the timer 267. The activated timer 267 causes the trigger IC 255 to continuously output a voltage high. In response to the voltage high, the voice (or other sound) synthesizing IC 257 continuously plays over the speaker 256. Preferably, the switch S4 is a two-position push-button switch electrically connected to the circuit 253 and operably positioned on the exterior of the rear housing assembly 18. In other embodiments, any of a number of commercially available two-position switches may be used.

In one embodiment, the voice synthesizing IC may have more than one voice recording that may be selected using a switch electrically connected to a voice synthesizing IC capable of storing more than one voice. The circuit may also have a tone generating IC as well as a voice synthesizing IC such that a switch mounted on the front or rear housing assembly allows a user to select between hearing sound or voice. Any of a number of known switches may be used.

From the foregoing, an improved novelty drinking straw has been described having improved safety and operability. It is intended that the foregoing detailed description be regarded as illustrative rather than limiting, and that it be understood that the following claims, including all equivalents, are intended to define the scope of this invention.

We claim:

1. A novelty drinking straw comprising:

a straw for receiving a liquid, the straw comprising a hollow tubular member having a length and a circumference;

two electrically conductive contacts, each of the contacts having a first portion positioned inside the straw and a second portion positioned outside the straw;

a sealing module coaxially disposed about the circumference of the straw, wherein the sealing module is sized to receive the electrically conductive contacts and prevent the liquid from escaping through the circumference of the hollow tubular member;

a first outer housing assembly removably connected to the sealing module, the first outer housing having a first integrally formed connector; and a second outer housing assembly having a sound generating module electrically connectable with the electrically conductive contacts, and a second integrally formed connector, the second integrally formed connector cooperative with the first integrally formed connector to form a manually detachable connection between the first and second outer housing assemblies, wherein the sound module is removable from the straw with the second outer housing assembly.

2. The apparatus of claim 1, wherein the second outer housing comprises:

a rear outer shell;

a front support plate connectable to the rear outer shell; and wherein the sound generating module is positioned inside a cavity formed by the rear outer shell and the front support plate.

3. The apparatus of claim 2, wherein the a second integrally formed connector is formed on the front support plate.

4. The apparatus of claim 1 wherein the first and second integrally formed connectors form a polarized joint.

5. The apparatus of claim 1, wherein the sealing module further comprises at least one flexible seal, the seal positioned around a circumference of the electrical contacts.

6. The apparatus of claim 1, wherein the sealing module further comprises a sealing material positioned around the circumference of the hollow tubular member and between the pair of electrical contacts.

7. The apparatus of claim 1, wherein the first outer housing assembly comprises:

a front outer shell; and a rear support plate, wherein the front outer shell is releasably attached to a first side of the rear support plate and the first integrally formed connector is formed on the rear support plate.

8. A novelty drinking straw comprising:

a straw for receiving a liquid, the straw comprising a hollow tubular member having a length and a circumference;

two electrically conductive contacts, each of the contacts having a first end positioned inside the straw and a second end positioned outside the straw, wherein each of the contacts passes through a respective opening in the circumference of the hollow tubular member;

a sealing module mounted on the straw and sized to receive the electrically conductive contacts and prevent the liquid from escaping the circumference of the hollow tubular member; and an outer housing removably attachable to the sealing module and the straw, wherein the housing comprises: an outer shell structure;

a support plate connected to the outer shell structure and comprising a connector portion manually attachable to the sealing module; and a sound generating module positioned inside a cavity formed by the outer shell and the support plate, wherein the outer housing and attached sound generating module are manually detachable from the straw.

9. A novelty drinking straw comprising:

A drinking straw having a tubular body;

at least one electrical contact having a first portion in communication with an interior of the tubular body and a second portion positioned outside of the tubular body;

a sealing module comprising a tubular section coaxially disposed about the tubular body and a seal positioned about each of the at least one electrical contacts, wherein the seal is positioned to prevent leakage of a liquid through a wall of the tubular member adjacent to the at least one electrical contact;

a first housing assembly positioned around the sealing module and enclosing the sealing module, wherein the first housing assembly comprises a front outer shell and a rear panel, the rear panel defining an opening for the at least one electrical contact; and a second housing assembly connected to the first housing assembly, the second housing assembly comprising a front panel, a rear outer shell, and a sound producing module, wherein the sound producing module is in electrical contact with the at least one electrical contact and wherein the sound producing module produces a sound when the liquid passes through the tubular body of the drinking straw.

10. The apparatus of claim 9, wherein the second housing assembly is detachably connected to the first housing assembly.

11. The apparatus of claim 1 0, wherein the rear panel of the first housing assembly and the front panel of the rear housing assembly cooperate to form a manually detachable joint.

12. The apparatus of claim 11, wherein the rear panel comprises an integrally formed connector and the front panel comprises an integrally formed connector.

13. The apparatus of claim 12, wherein the integrally formed connector in the rear panel comprises a female connector and the integrally formed connector in the front panel comprises a male connector.

14. The apparatus of claim 9, wherein the seal comprises an elastomeric seal.

15. The apparatus of claim 14, wherein the elastomeric seal comprises a synthetic rubber material.

16. The apparatus of claim 14, wherein the seal comprises a plastic material.

17. The apparatus of claim 9, wherein the sound module comprises an electronic circuit having a power source, a speaker, and a voice synthesizing circuit.

18. The apparatus of claim 1, wherein the sound module further comprises a manually operable switch.

19. The apparatus of claim 17, wherein the voice synthesizing circuit comprises a prerecorded song.

20. The apparatus of claim 18, wherein the switch further comprises an off position, where the sound module is completely deactivated, and an on position, where the sound module is responsive to a liquid passing through the straw to play a prerecorded voice.

21. The apparatus of claim 17, wherein the power source comprises at least one battery.

22. The apparatus of claim 1, wherein the tubular body of the drinking straw comprises a non-frangible plastic.

23. The apparatus of claim 17, wherein the electronic circuit further comprises a switch manually operable to initiate continuous operation of the electronic circuit in absence of a liquid in the straw.

24. The apparatus of claim 9, wherein the sound module comprises an electronic circuit configured to play a prerecorded voice.

25. The apparatus of claim 9, wherein the sound module comprises an electronic circuit configured to play a prerecorded sound.

26. The apparatus of claim 1, wherein the sound module further comprises a switch, the switch switchable between a first position wherein the sound module continuously plays one of a voice and a sound, and a second position wherein the sound module plays one of a voice and a sound in response to a liquid passing through the straw.

* * * * *

UNITED STATES PATENT AND TRADEMARK OFFICE

CERTIFICATE OF CORRECTION

PATENT NO. : 6,129,292
DATED : October 10, 2000
INVENTOR(S) : Wallace W. K. Leung et al.

It is certified that error appears in the above-identified patent and that said Letters Patent is hereby corrected as shown below:

Claim 3,
Line 1, change "the a second" to -- the second --.

Claim 22,
Line 1, change "body" to -- member --.

Signed and Sealed this

Sixth Day of November, 2001

*Attest:*

Nicholas P. Godici

*Attesting Officer*

NICHOLAS P. GODICI
*Acting Director of the United States Patent and Trademark Office*